US008305187B2

(12) United States Patent
Chin

(10) Patent No.: US 8,305,187 B2
(45) Date of Patent: Nov. 6, 2012

(54) VARIABLE RESISTOR DEVICE FOR DISPLAY DEVICE AND METHOD OF CONTROLLING VARIABLE RESISTANCE USING THE SAME

(75) Inventor: Heung-Suk Chin, Yongin (KR)

(73) Assignee: Samsung Display Co., Ltd., Yongin, Gyunggi-do (KR)

( * ) Notice: Subject to any disclaimer, the term of this patent is extended or adjusted under 35 U.S.C. 154(b) by 0 days.

(21) Appl. No.: 13/137,963

(22) Filed: Sep. 22, 2011

(65) Prior Publication Data

US 2012/0194318 A1 Aug. 2, 2012

(51) Int. Cl.
*H01C 10/00* (2006.01)

(52) U.S. Cl. ..... 338/68; 338/162; 338/180; 338/186

(58) Field of Classification Search ..... 338/68, 338/162, 180

See application file for complete search history.

(56) References Cited

U.S. PATENT DOCUMENTS 5,157,371 A * 10/1992 Sundquist et al. ..... 338/162
5,929,745 A 7/1999 Tsunezawa et al.
6,040,757 A * 3/2000 Masuda et al. ..... 338/160
6,100,786 A * 8/2000 Ryu ..... 338/128
6,798,333 B1 * 9/2004 Morikami ..... 338/162
7,817,011 B2 10/2010 Araki
2008/0246702 A1 10/2008 Lee et al.

FOREIGN PATENT DOCUMENTS

KR 10-1997-0067397 A 10/1997
KR 10-2004-0066562 A 7/2004
KR 10-2006-0071700 A 6/2006
KR 10-2007-0029117 A 3/2007
KR 10-2008-0090879 A 10/2008

* cited by examiner

*Primary Examiner* — Kyung Lee
(74) *Attorney, Agent, or Firm* — Lee & Morse, P.C.

(57) ABSTRACT

A display device includes a display panel on which a pixel electrode and a common electrode are patterned, and a variable resistor configured to vary a common voltage applied to the common electrode. The variable resistor includes a variable resistance control unit configured to control resistances between resistance terminals that are electrically connected to one another. The variable resistance control unit includes a crown unit, a crown axis combined with the crown unit and configured to guide up/down movement of the crown unit, a first motion variable unit combined with the crown axis, a second motion variable unit selectively combined with the first motion variable unit and configured to vary a variable resistance due to rotary power transmitted from the crown unit, and a housing unit configured to accommodate the crown unit, the crown axis, the first motion variable unit, and the second motion variable unit

25 Claims, 7 Drawing Sheets

VARIABLE RESISTOR DEVICE FOR DISPLAY DEVICE AND METHOD OF CONTROLLING VARIABLE RESISTANCE USING THE SAME

CROSS-REFERENCE TO RELATED PATENT APPLICATION

This application claims the benefit of Korean Patent Application No. 10-2011-0008250, filed on Jan. 27, 2011, in the Korean Intellectual Property Office, the disclosure of which is incorporated herein in its entirety by reference.

BACKGROUND

A display panel, such as a liquid crystal display (LCD) panel, may be a non-emissive display panel that cannot emit light per se to create an image but receives external light, e.g., from a backlight, to display an image.

An LCD panel may include a plurality of substrates on which pixel electrodes and common electrodes are patterned, and a liquid crystal (LC) layer having dielectric anisotropy. The LC layer may be injected between the plurality of substrates. The pixel electrodes may be arranged in a matrix form and connected to switching elements, such as thin film transistors (TFTs). According to an exemplary embodiment, rows of the pixel electrodes may sequentially receive a data voltage such that the data signal is applied to one row of the pixel electrodes each time. The common electrodes may be formed on the substrate, e.g., on the entire surface of the substrate, and receive a common voltage.

The LCD panel may generate an electric field in the LC layer in response to the data signal and adjust the transmittance of light passing through the LC layer by adjusting the intensity of the electric field. Thus, the LCD panel may display a desired image.

SUMMARY

Embodiments may be realized by providing a variable resistor device including a display panel on which a pixel electrode and a common electrode are patterned, and a variable resistor configured to vary a common voltage applied to the common electrode. The variable resistor including a plurality of resistance terminals disposed on a circuit board and a variable resistance control unit configured to control resistances between the resistance terminals electrically connected to one another, wherein the variable resistance control unit comprises a crown unit, a crown axis combined with the crown unit and configured to guide up/down movement of the crown unit, a first motion variable unit combined with the crown axis, a second motion variable unit selectively combined with the first motion variable unit and configured to vary a variable resistance due to rotary power transmitted from the crown unit, and a housing unit configured to accommodate the crown unit, the crown axis, the first motion variable unit, and the second motion variable unit.

Embodiments may also be realized by providing a method of controlling a variable resistance using a variable resistor device of a display device. The variable resistor device includes a display panel in which a pixel electrode and a common electrode are patterned, and the variable resistor device being configured to vary a common voltage applied to the common electrode and to control the variable resistance control unit of a variable resistor to control resistances between a plurality of resistance terminals formed on a circuit board. The method comprising elevating a crown unit of the variable resistor comprising the crown unit having an axis unit, a crown axis combined with the crown unit and configured to guide up/down movement of the crown unit, a first motion variable unit combined with the crown axis, a second motion variable unit selectively combined with the first motion variable unit, and a housing unit configured to accommodate the crown unit, the crown axis, the first motion variable unit, and the second motion variable unit; descending the first motion variable unit to a bottom unit of the housing unit by allowing a lever hinge-jointed with the axis unit to rotate downward due to the elevation of the crown unit and apply pressure to the first motion variable unit; combining the first motion variable unit with the second motion variable unit at the bottom unit of the housing unit; and varying the variable resistance by allowing the second motion variable unit to receive rotary power from the crown unit and at least partially contact a resistance layer electrically connected to the resistance terminals formed on the circuit board.

Embodiments may also be realized by providing a method of controlling a variable resistance using a variable resistor device of a display device. The variable resistor device including a display panel in which a pixel electrode and a common electrode are patterned, and the variable resistor device being configured to vary a common voltage applied to the common electrode and to control the variable resistance control unit of a variable resistor to control resistances between a plurality of resistance terminals formed on a circuit board. The method comprising descending a crown unit of the variable resistor comprising the crown unit having an axis unit, a crown axis combined with the axis unit and configured to guide up/down movement of the axis unit, a first motion variable unit combined with an end portion of the axis unit, a second motion variable unit selectively combined with the first motion variable unit, and a housing unit configured to accommodate the crown unit, the crown axis, the first motion variable unit, and the second motion variable unit; descending the first motion variable unit combined with the end portion of the axis unit to a bottom unit of the housing unit along the crown axis; combining the first motion variable unit with the second motion variable unit at the bottom unit of the housing unit; and varying the variable resistance by allowing the second motion variable unit to receive rotary power from the crown unit and at least partially contact a resistance layer formed on the circuit board and electrically connected to the resistance terminals.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
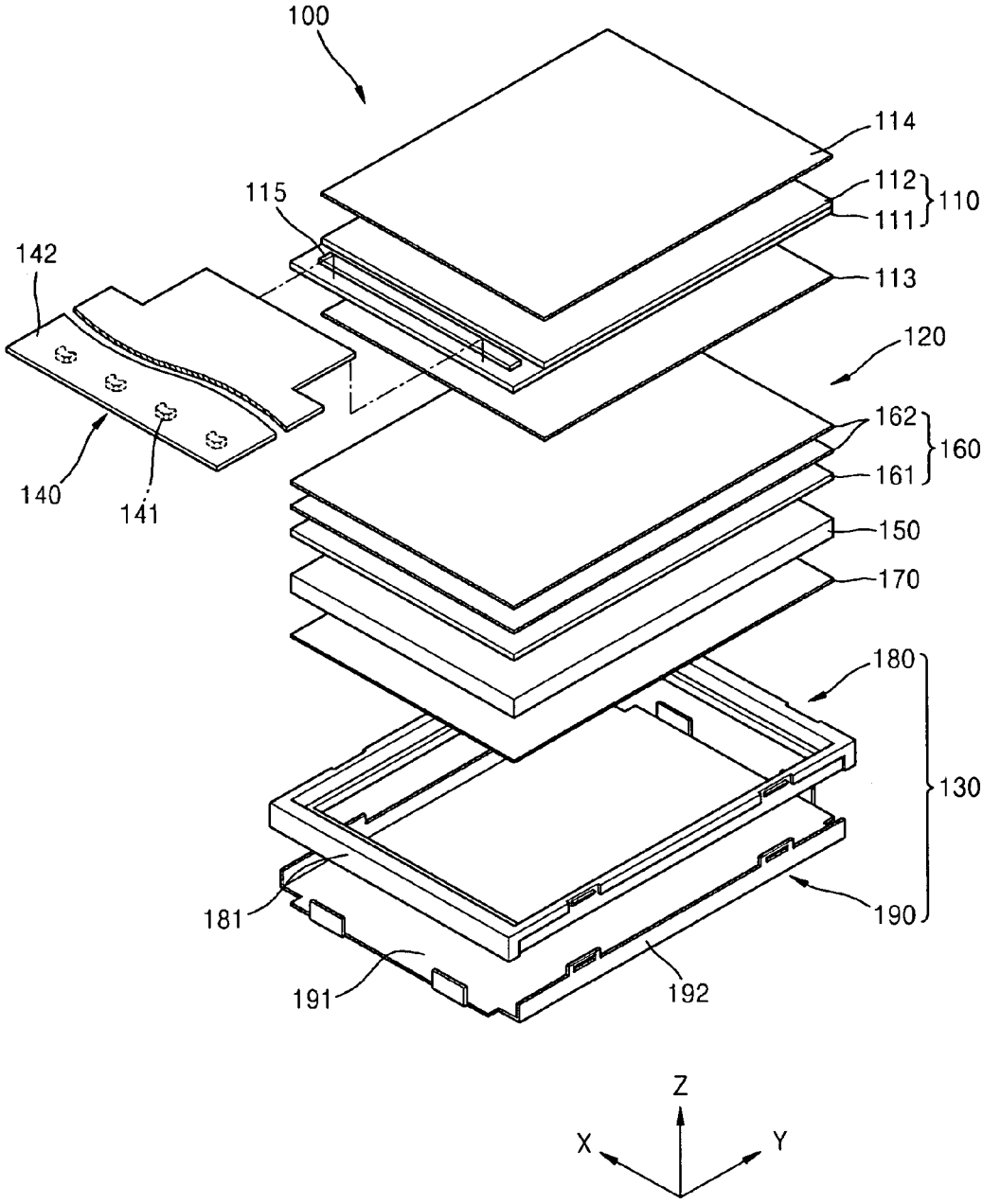
FIG. 1 illustrates an exploded perspective view of a display device, according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when an element is referred to as being "on" another element, it can be directly on the other element, or intervening elements may also be present. Further, it will also be understood that when an element is referred to as being "between" two layers, it can be the only element between the two elements, or one or more intervening elements may also be present. Like reference numerals refer to like elements throughout.

FIG. 1 is an exploded perspective view of a display device 100 according to an exemplary embodiment of.

Referring to FIG. 1, the display device 100 may include a liquid crystal display (LCD) panel 110, a backlight unit (BLU) 120, and a housing unit 130.

The LCD panel 110 may include a first substrate 111, a second substrate 112 disposed opposite the first substrate 111, and liquid crystals (LCs) injected in an liquid crystal (LC) layer 201 between the first and second substrates 111 and 112.

A first polarizer 113 may be adhered to an outer surface of the first substrate 111, and a second polarizer 114 may be adhered to an outer surface of the second substrate 112. The first polarizer 113 may polarize light generated by the BLU 120 in a direction, e.g., a direction substantially perpendicular to a polarization direction, and emit the light toward the LCD panel 110. The second polarizer 114 may polarize light generated by the LCD panel 110 in a direction, e.g., a direction substantially perpendicular to the polarization direction, and externally emit the light.

A driver integrated circuit (IC) 115 may be mounted on an edge of the first substrate 111. The driver IC 115 may generate a driving signal for driving the LCD panel 110 in response to an externally applied voltage. The driver IC 115 may be electrically connected to the first substrate 111 by, e.g., a conductive adhesive, such as an anisotropic conductive film (ACF).

The BLU 120 may include a light source unit 140, a light guide plate (LGP) 150, a plurality of optical sheets 160, and a reflective sheet 170. The light source unit 140 may include at least one light source element 141 configured to supply light to a lateral portion of the LGP 150, and a circuit board 142 on which the light source element 141 is mounted.

The light source element 141 may be a cold cathode fluorescent lamp (CCFL), an external electrode fluorescent lamp, or a light emitting diode (LED). The light source element 141 may include at least one LED configured to irradiate white light. The number of the light source elements 141 may depend on the size of the LCD panel 110 and a desired luminance. The light source elements 141 may be arranged on the circuit board 142 and spaced a predetermined distance apart from one another.

The circuit board 142 may transmit an electric signal to the LCD panel 110. The circuit board 142 may be a flexible printed circuit board (FPCB) or a hard printed circuit board (HPCB). According to an exemplary embodiment, the circuit board 142 may be an FPCB.

One end portion of the circuit board 142 may be electrically connected to the edge of the first substrate 111. The circuit board 142 may have flexibility and surround an outer lateral portion of a mold frame 180.

A plurality of light source elements 141 may be arranged a predetermined distance apart from one another in a lengthwise direction X of a side portion 181 of the mold frame 180. Closely adhering front surfaces of the light source elements 141 with a lateral portion of the LGP 150 may be advantageous to reduce luminance dispersion.

The LGP 150 may be installed under the LCD panel 110, e.g., on a side of the LCD panel 110 that is opposite the image viewing side of the LCD panel 110. The LGP 150 may guide light generated by the light source element 141 toward the LCD panel 110. The LGP 150 may be formed to have a specific pattern to provide a uniform surface light source.

The optical sheet 160 may be interposed between the LCD panel 110 and the LGP 150. The optical sheet 160 may include at least one sheet to improve luminous efficiency. The optical sheet 160 may include a diffuser sheet 161 and at least one prism sheet 162 disposed on the diffuser sheet 161.

The reflective sheet 170 may be adhered to a rear surface of the LGP 150. The reflective sheet 170 may reflect light traveling below the LGP 150 toward the LCD panel 110.

The housing unit 130 may include the mold frame 180 and a case 190. The mold frame 180 may provide a space for accommodating the LGP 150, the optical sheets 160, and the reflective sheet 170. The mold frame 180 may be a rectangular frame having a central opening. The mold frame 180 may be mounted in the case 190.

The case 190 may include a bottom portion 191 on which the mold frame 180 is mounted and a side portion 192 bent in a vertical direction from an edge of the bottom portion 191. The side portion 192 may be combined with the mold frame 180 using, e.g., a hook combination process.

The case 190 may be formed of a metal material, e.g., aluminum (Al), having a high intensity and may minimize deformation of the display device 100. An additional case (not shown) for covering the LCD panel 110, the BLU 120, and the mold frame 180 may be further installed over the case 190 and combined with the case 190.

Figure 2:
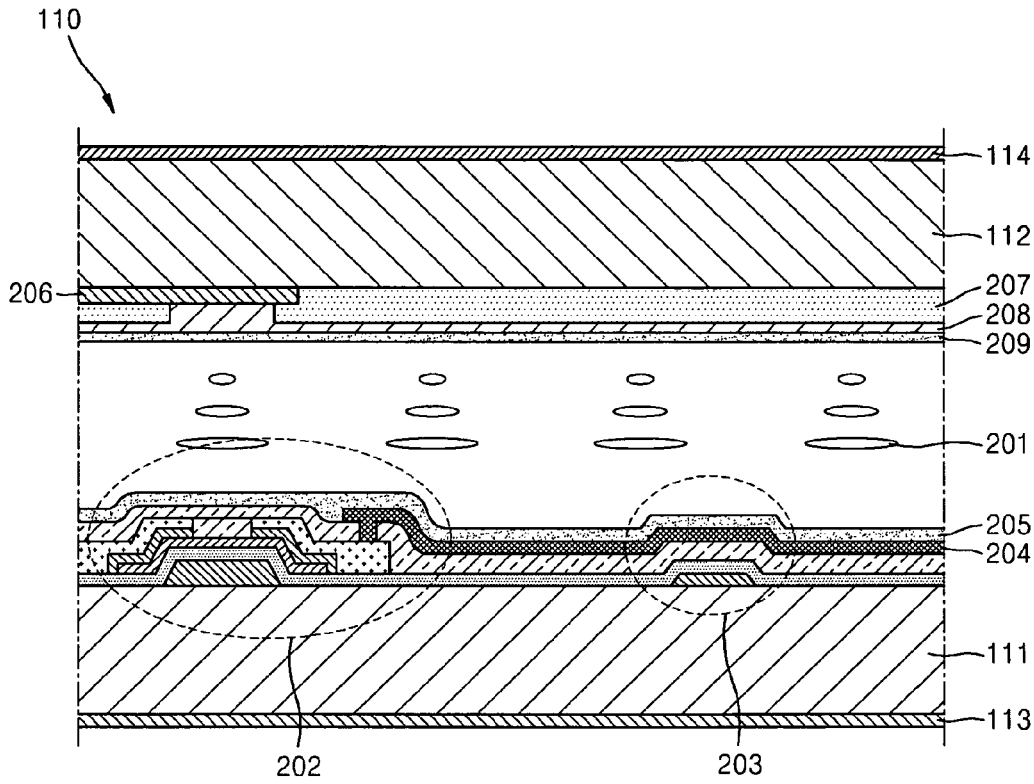
FIG. 2 illustrates a cross-sectional view of an exemplary liquid crystal display (LCD) panel of the display device of FIG. 2.

FIG. 2 is a cross-sectional view of the LCD panel 110 of FIG. 2.

Referring to FIG. 2, the LCD panel 110 may include the first substrate 111, the second substrate 112, and the LC layer 201 injected between the first and second substrates 111 and 112. A plurality of gate lines (refer to GL0, GL1, GL2, . . . , and GLn in FIG. 3) and a plurality of data lines (refer to DL1, DL2, DL3, . . . , and DLm in FIG. 3) may be patterned on the first substrate 111 and may intersect one another at substantially right angles. Unit pixels may be defined by the intersection of the gate lines GL0, GL1, GL2, . . . , and GLn and the data lines DL1, DL2, DL3, . . . , and DLm. A thin film transistor (TFT) 202 may serve as a switching device and a storage capacitor 203 may be patterned at each of the intersections between the gate lines GL0, GL1, GL2, . . . , and GLn and data lines DL1, DL2, DL3, . . . , and DLm to drive the unit pixels. A pixel electrode 204 configured to apply an electric field to the LC layer 201 may be formed in each of the unit pixels and connected to the TFT 202. A first alignment layer 205 may be formed on the pixel electrode 204.

A black matrix 206 configured to reduce and/or prevent light leakage and a color filter 207 configured to embody red(R), green(G), and blue(B) colors may be disposed on the second substrate 112. A common electrode 208 may be formed on the color filter 207. A second alignment layer 209 may be formed on the common electrode 208.

As described above, the pixel electrode 204 may be patterned on the first substrate 111, and the common electrode 208 may be formed on the second substrate 112. The pixel electrode 204 and the common electrode 208 may apply an electric field to the LC layer 201 and adjust the arrangement of LCs.

Figure 3:
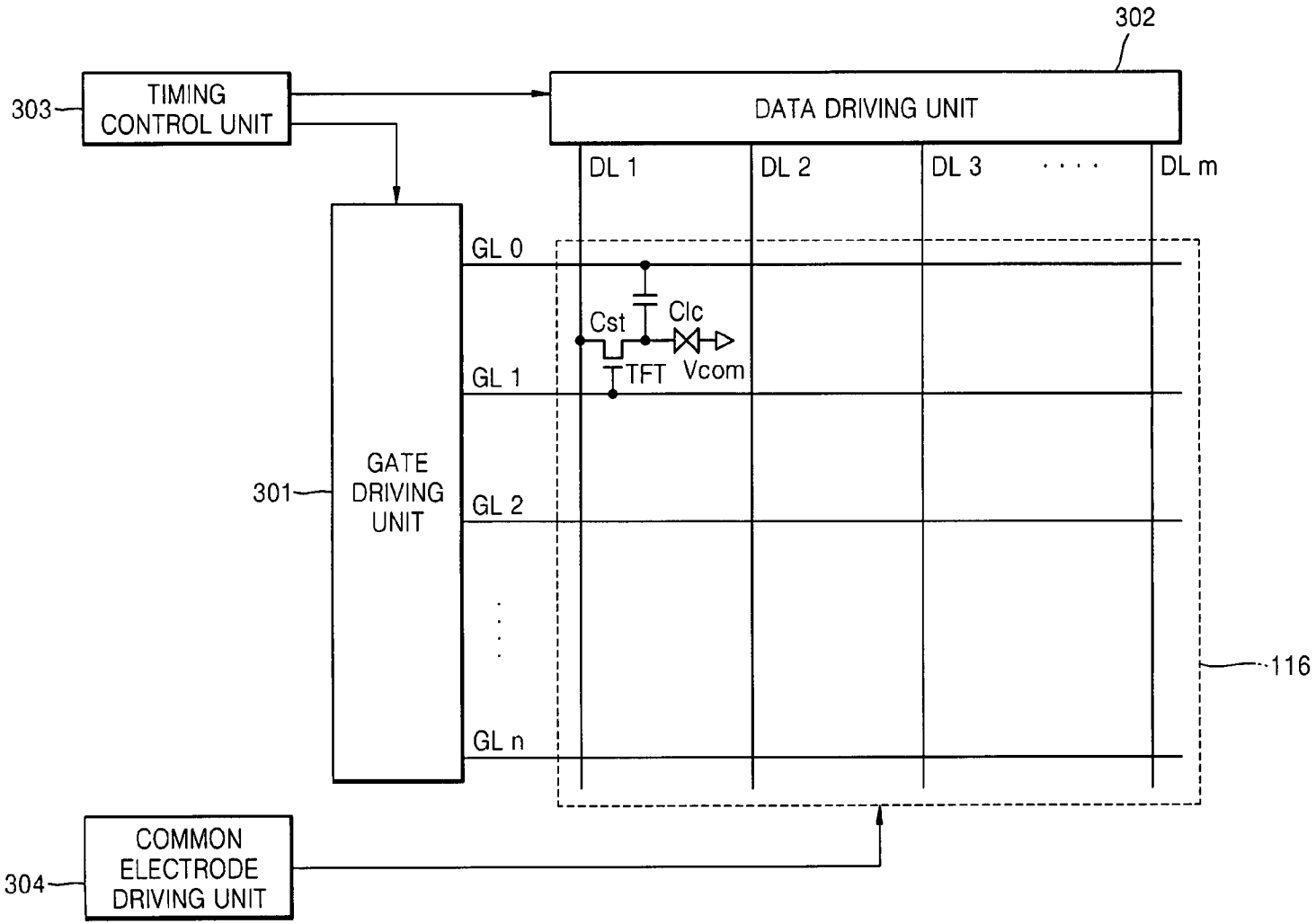
FIG. 3 illustrates a construction diagram showing an exemplary connection state of a pattern of the LCD panel of FIG. 2.

FIG. 3 is a construction diagram showing a connection state of a pattern of the LCD panel 110 of FIG. 2.

Referring to FIG. 3, the LCD panel 110 may include an LC panel 116 on which LC cells are arranged in a matrix form, a gate driver 301 configured to drive the plurality of gate lines GL0, GL1, GL2, . . . , and GLn, a data driver 302 configured to drive the plurality of data lines DL1, DL2, DL3, . . . , and DLm, a timing controller 303 configured to control the gate driver 301 and the data driver 302, and a common electrode driver 304 configured to apply a common voltage to a common electrode (refer to 208 in FIG. 2).

The LC panel 116 may include LC cells arranged in a matrix form and the TFT (refer to 202 in FIG. 2) formed at, e.g., each of the intersections between the gate lines GL0, GL1, GL2, . . . , and GLn and the data lines DL1, DL2, DL3, . . . , and DLm. Each of the LC cells may be expressed by a droplet capacitor Clc and may include the pixel electrode 204 and the common electrode 208 (Vcom), which may be disposed opposite each other with the LC layer (refer to 201 in FIG. 2) therebetween, and the storage capacitor 203 (Cst) configured to stably maintain a charged data signal until the next data signal is charged.

The LCD panel 110 may vary an arrangement state of the LC layer 201 having dielectric anisotropy in response to an applied data signal and adjust an optical transmittance, thus displaying a grayscale. In this case, a data signal expressed by a predetermined voltage may be applied to the pixel electrode 204, while a common voltage may be applied to the common electrode 208.

The common electrode driver 304 may be an element configured to apply a common voltage to the common electrode 208. The common electrode driver 304 may include a direct-current/direct-current (DC-DC) converter and apply an externally applied DC voltage to the common electrode 208.

Figure 4:
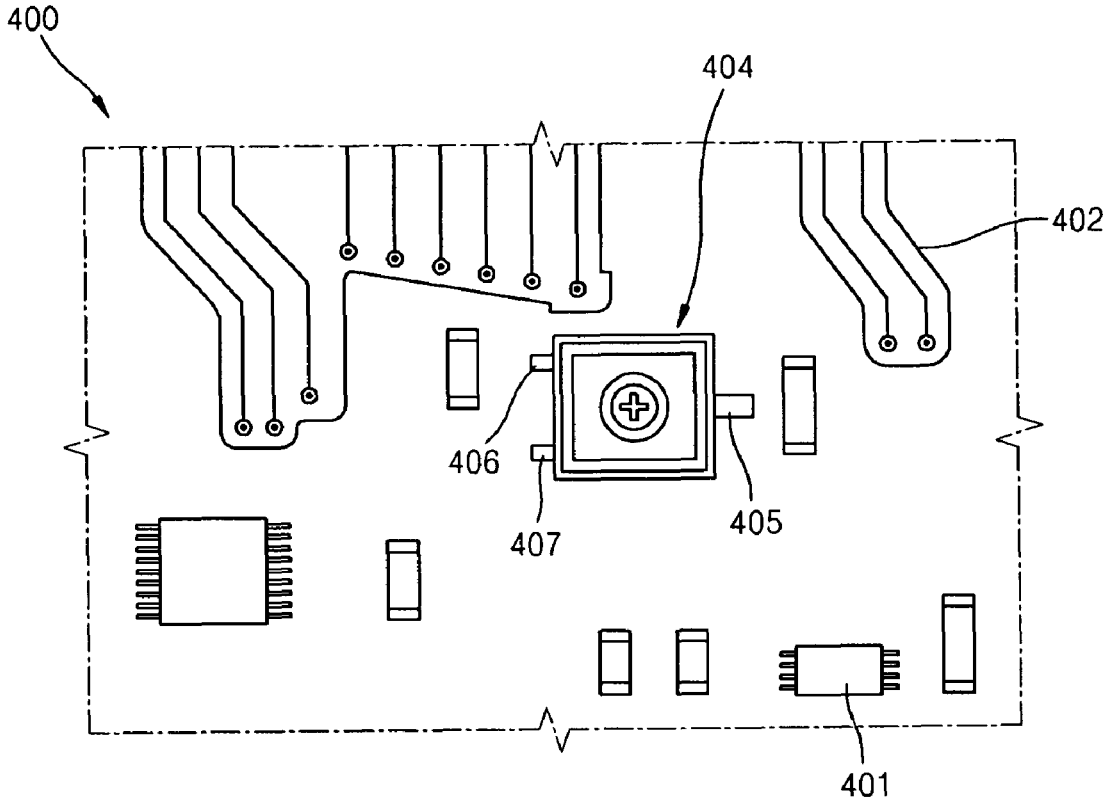
FIG. 4 illustrates an enlarged plan view of an exemplary circuit board in which a variable resistor device is installed, according to an exemplary embodiment.

FIG. 4 is an enlarged plan view of a circuit board 400 of the display device 100 of FIG. 1, in which the variable resistor of FIG. 1 is installed.

Referring to FIG. 4, the display device 100 may include a gate or data circuit board to which a graphic signal and a control signal are applied from a system board, or a gate tape carrier package (gate TCP) or data TCP electrically connected to the gate or data circuit board. The circuit board 400 may be any one of the above-described gate and data circuit boards. A plurality of electronic elements 401 may be mounted on the circuit board 400. A signal pattern 402 configured to transmit an electric signal may be patterned on the circuit board 400.

In this case, a variable resistor 404 for dividing a common voltage of the common electrode (refer to 208 in FIG. 2) may be mounted on the circuit board 400. The common voltage may be controlled by adjusting the variable resistor 404. The variable resistor 404 may control the common voltage serving as a reference voltage of an electric signal and improve the resolution of a screen.

The variable resistor 404 may be controlled using a variable resistance control unit (refer to 500 in FIG. 5), which may protrude outward from the circuit board 400. When the common voltage departs from a reference value, voltage disparity may occur between the pixel electrode 204 and the common electrode 208. To reduce flickering, the common voltage may be manually controlled using a control unit, such as a driver.

Figure 5A:
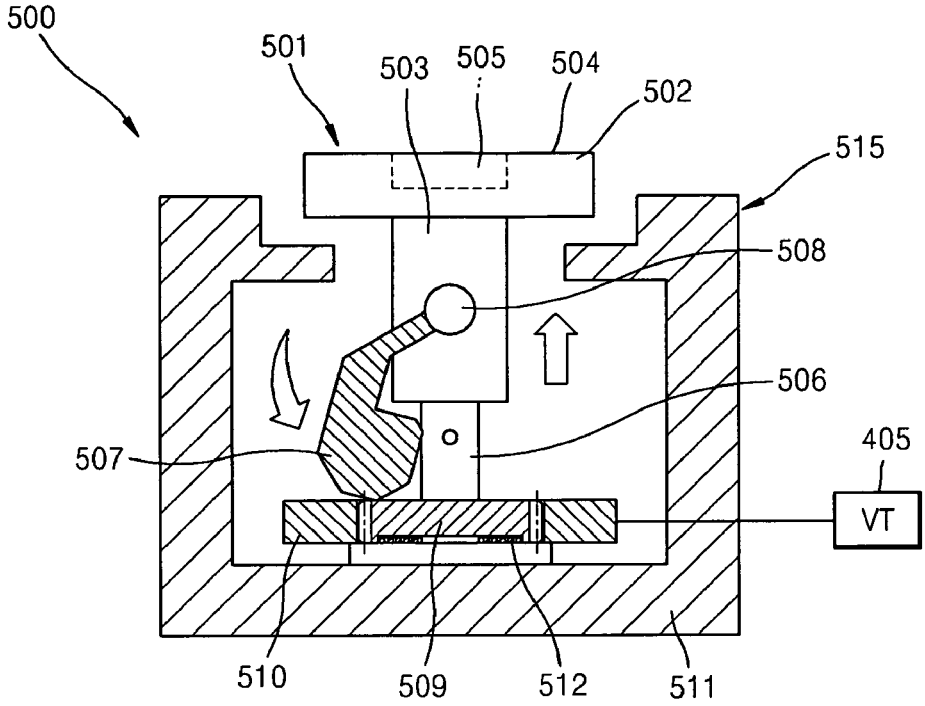
FIG. 5A illustrates a cross-sectional view of a state where a variable resistance is being controlled using a variable resistance control unit, according to an exemplary embodiment.
Figure 5B:
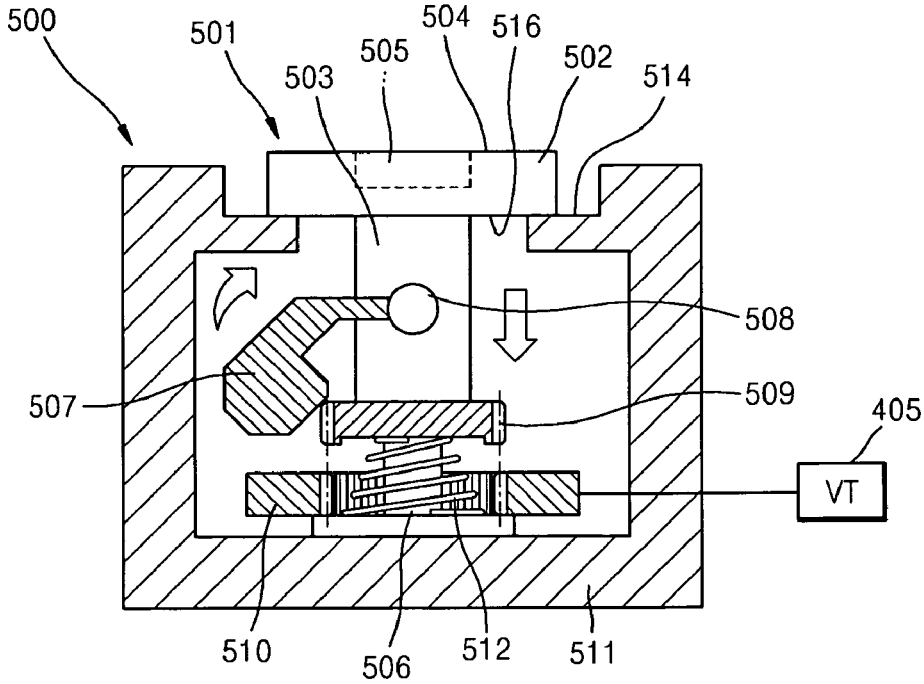
FIG. 5B illustrates a cross-sectional view of a state where the variable resistance of FIG. 5A is already controlled, according to an exemplary embodiment.
Figure 5C:
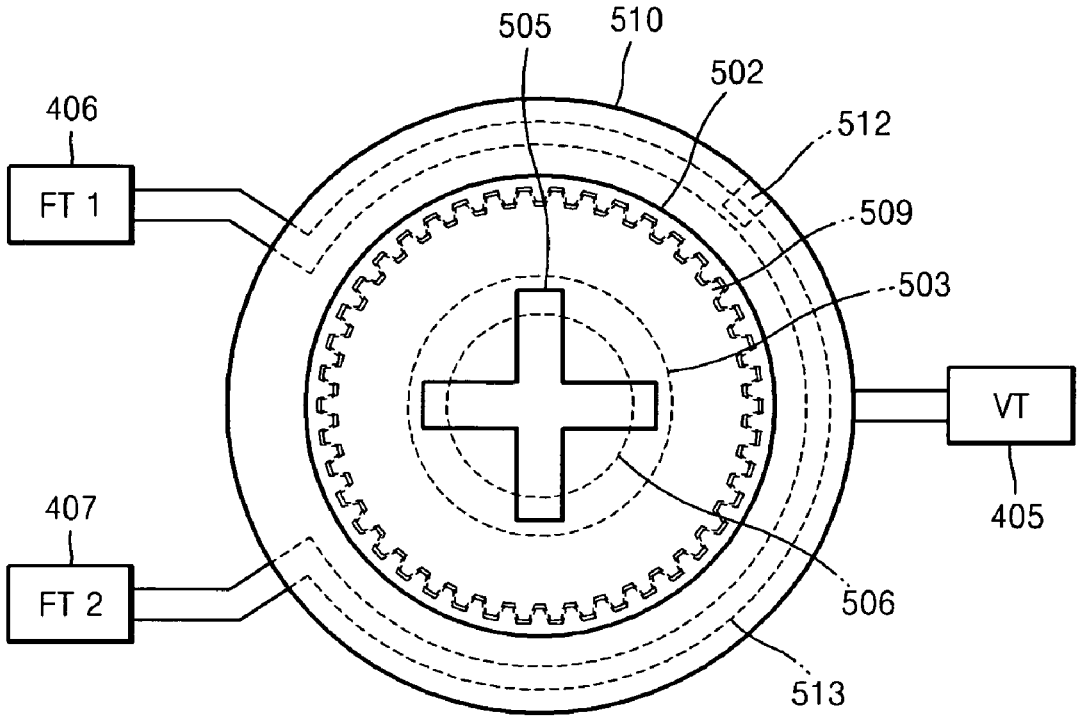
FIG. 5C illustrates a plan view of the state where the variable resistance of FIG. 5A is being controlled, according to an exemplary embodiment.

FIG. 5A is a cross-sectional view of a state where a variable resistance is being controlled using the variable resistance control unit 500, according to an exemplary embodiment, FIG. 5B is a cross-sectional view of a state where the variable resistance of FIG. 5A is already controlled, and FIG. 5C is a plan view of the state where the variable resistance of FIG. 5A is being controlled.

Referring to FIGS. 5A through 5C, the variable resistance control unit 500 may include a crown unit 501, a crown axis 506, a first motion variable unit 509, a second motion variable unit 510, and a housing unit 515. The variable resistance control unit 500 may be electrically connected to respective first to third resistance terminals 405 to 407 of the variable resistor (refer to 404 in FIG. 4), and a common voltage may vary by adjusting the variable resistor control unit 500.

The crown unit 501 may be prepared in the variable resistance control unit 500. The crown unit 501 may function as a handle and be combined with a control unit, such as a driver. The crown unit 501 may include a disk unit 502 and an axis unit 503 configured to extend downwardly from the disk unit 502. An "I" or "+"-shaped screw groove 505 capable of rotating the crown unit 501 may be formed in a top surface 504 of the crown unit 501. Alternatively, the crown unit 501 may be self-rotatable without the screw groove 505.

The crown axis 506 may be combined with the axis unit 503. The crown axis 506 may be inserted into a hollow formed in the axis unit 503. The crown axis 506 may serve to guide the axis unit 503 such that the axis unit 503 may be capable of moving up and down along the crown axis 506. Although not shown, when the axis unit 503 ascends along the crown axis 506 and reaches a desired upper limit of the crown axis 506, a stop unit, such as a stopper, may be naturally prepared to set the upper limit.

A lever 507 may be combined with the axis unit 503. The lever 507 may be hinge-jointed with the axis unit 503. The lever 507 may be capable of rotating upward and downward due to up/down movement of the axis unit 503. That is, when the axis unit 503 ascends, the lever 507 may rotate in a downward direction due to gravity, whereas when the axis unit 503 descends, the lever 507 may rotate in an upward direction by reaction.

The first motion variable unit 509 may be combined with the crown axis 506. The first motion variable unit 509 may include a conductive annulus having a central through hole into which the crown axis 506 may be inserted. The first motion variable unit 509 may be capable of moving up and down along the crown axis 506. Simultaneously, when the first motion variable unit 509 is selectively combined with the second motion variable unit 510, the first motion variable unit 509 may be rotatable along with the crown axis 506 while rotating the crown unit 501 in one direction. In the present embodiment, the first motion variable unit 509 may have a saw-toothed unit along an outer circumferential surface thereof, but embodiments are not limited thereto.

An elastic bias unit 512 may be installed between the first motion variable unit 509 and a bottom unit 511 of the housing unit 515. The first motion variable unit 509 may be capable of moving up and down along the crown axis 506 due to the elasticity of the elastic bias unit 512. The elastic bias unit 512 may be a spring or a cushion tape. The elastic bias unit 512 may surround the crown axis 506.

The second motion variable unit 510 may be disposed near the bottom unit 511 of the housing unit 515. The second motion variable unit 510 may be a conductive annulus disposed along a circumference of the first motion variable unit 509. The second motion variable unit 510 may be electrically connected to the first resistance terminal 405 (VT) to control a variable resistance. According to an exemplary embodiment, the second motion variable unit 510 may have a saw-toothed unit along an inner circumferential surface thereof, but embodiments are not limited thereto. The second motion variable unit 510 may be selectively combined and rotatably interlocked with the first motion variable unit 509.

The crown unit 501, the crown axis 506, the first motion variable unit 509, and the second motion variable unit 510 may be accommodated in the housing unit 515.

Function of the variable resistance control unit 500 having the above-described construction will now be described.

To operate the variable resistance control unit 500 to, e.g., reduce flickering, the disk unit 502 of the crown unit 501 may be pulled upward as shown in FIG. 5A. When the axis unit 503 of the crown unit 501 moves upward along the crown axis 506, the lever 507 hinge-jointed (refer to 508) with the axis unit 503 may rotate downward.

When the lever 507 is rotated downward, the first motion variable unit 509 contacting a bottom unit of the lever 507 may also descend along the crown axis 506 by an angle at which the lever 507 rotates. When the first motion variable unit 509 moves down to the bottom unit 511 of the housing unit 515, the lever 507 may apply pressure to the first motion variable unit 509. In this case, the elastic bias unit 512 interposed between the first motion variable unit 509 and the bottom unit 511 of the housing unit 515 may remain compressed. In addition, further upward movement of the crown unit 501 may be inhibited.

After moving downward, the first motion variable unit 509 may be combined with the second motion variable unit 510. That is, since both the outer circumferential surface of the first motion variable unit 509 and the inner circumferential surface of the second motion variable unit 510 have saw-toothed units, the first and second motion variable units 509 and 510 may engage with each other.

Next, when a driver is combined with the screw groove 505 formed in the disk unit 502 of the crown unit 501 and the disk unit 502 rotates in one direction, the crown axis 506 combined with the axis unit 503 may rotate. When the crown axis 506 is rotated, the first motion variable unit 509 disposed at the bottom of the crown axis 506 may move, and the second motion variable unit 510 synchronized with the first motion variable unit 509 may be capable of rotating.

A resistance layer 513 having a semi-arc shape may be formed under the second motion variable unit 510. A second resistance terminal 406 (FT1) and a third resistance terminal 407 (FT2) may be electrically connected to both ends, e.g., at respective opposing ends, of the resistance layer 513. According to an exemplary embodiment, a first resistance terminal 405 (VT) may be connected to an external circuit, a constant voltage may be applied to the second resistance terminal 406 (FT1), and the third resistance terminal 407 (FT2) may be grounded.

When the second motion variable unit 510 rotates in one direction, a portion of the second motion variable unit 510, e.g., a contact 512 protruding from the second motion variable unit 510 may move on the resistance layer 513 and vary a variable resistance, and an electric potential of the second motion variable unit 510 may be set to a desired resistance value.

The configuration of the variable resistor is not limited to the above-described configuration of the first to third resistance terminals 405 to 407 and the above-described electrical connection of the first to third resistance terminals 405 to 407 with the second motion variable unit 510 and modified without any particular limitation when the variable resistor is capable of varying the variable resistance using the variable resistance control unit 500.

After a common voltage is controlled by controlling the variable resistance in the above-described manner, the common voltage may be fixed using the variable resistance control unit 500.

That is, as shown in FIG. 5B, the disk unit 502 of the crown unit 501 may be pushed downward. When the axis unit 503 of the crown unit 501 moves downward along the crown axis 506, the lever 507 hinge-jointed with the axis unit 503 may rotate upward.

When the lever 507 rotates upward, the compressive force of the elastic bias unit 511 interposed between the first motion variable unit 509 and the bottom unit 511 of the housing unit 515 may be removed. When the elastic bias unit 511 is restored, the first motion variable unit 509 may move upward along the crown axis 506 due to the elasticity of the elastic bias unit 512. Thus, a combination of the first motion variable unit 509 with the second motion variable unit 510 may be released.

The bottom unit 516 of the disk unit 502 may be disposed on a projection unit 514 of the housing unit 515. For example, the bottom unit 516 may be seated on the projection unit 514 when the disk unit 502 is pushed downward a predetermined distance. The projection unit 514 may inhibit further downward movement of the disk unit 502.

Figure 6A:
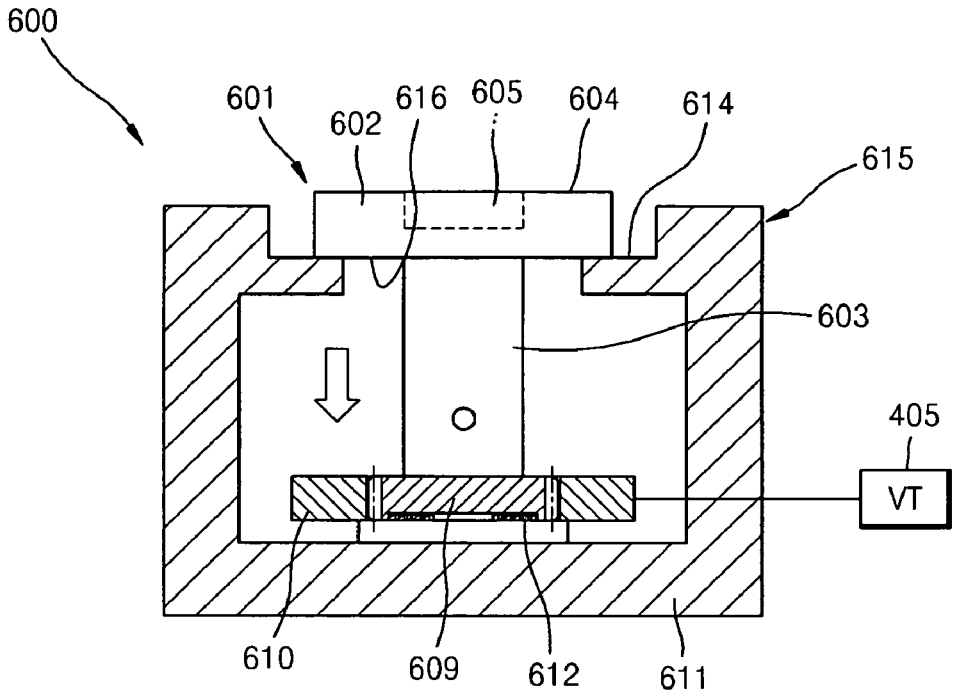
FIG. 6A illustrates a cross-sectional view of a state where a variable resistance is being controlled using a variable resistance control unit, according to an exemplary embodiment.
Figure 6B:
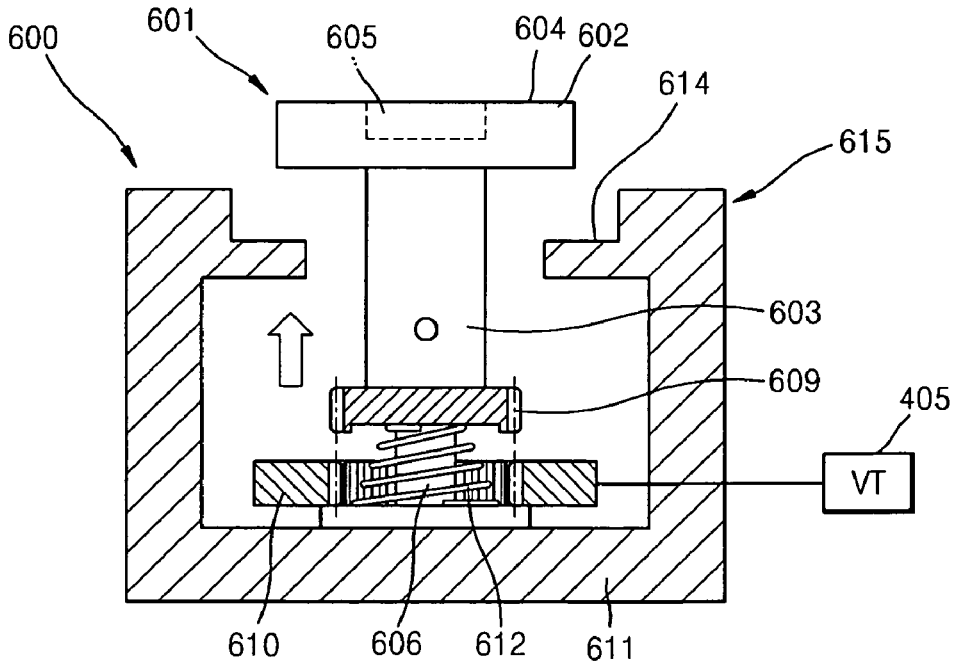
FIG. 6B illustrates a cross-sectional view of a state where the variable resistance of FIG. 6A is already controlled, according to an exemplary embodiment.

FIG. 6A is a cross-sectional view of a state where a variable resistance is being controlled using a variable resistance control unit 600, according to another exemplary embodiment, and FIG. 6B is a cross-sectional view of a state where the variable resistance of FIG. 6A is already controlled.

Referring to FIGS. 6A and 6B, the variable resistance control unit 600 may include a crown unit 601, a crown axis 606, a first motion variable unit 609, a second motion variable unit 610, and a housing unit 615. The crown unit 601 may include a disk unit 602 and an axis unit 603 having a hollow, which may extend downwardly from the disk unit 602. A screw groove 605 may be formed in a top surface 604 of the disk unit 602. The screw groove 605 may be selectively combined with a control unit, such as a driver, and may rotate the crown unit 601.

The crown axis 606 may be combined with the axis unit 603. The crown axis 606 may be inserted into the hollow of the axis unit 603 and serve to guide the axis unit 603. A first motion variable unit 609 may be combined with an end portion of the axis unit 603. The first motion variable unit 609 may be a conductive annulus having a central through hole through which the crown axis 606 may be inserted. The first motion variable unit 609 may be installed to reach a bottom portion 611 of the housing unit 615 when the axis unit 603 reaches a lower limit of the crown axis 606. In the present embodiment, the first motion variable unit 609 may have a saw-toothed unit along an outer circumferential surface thereof, but embodiments are not limited thereto.

An elastic bias unit 612 may be installed between the first motion variable unit 609 and the bottom portion 611 of the housing unit 615. The first motion variable unit 609 may be capable of moving up and down along the crown axis 606 due to the elasticity of the elastic bias unit 612.

The second motion variable unit 610 may be installed near the bottom portion 611 of the housing unit 615. The second motion variable unit 610 may be a conductive annulus disposed along a circumference of the first motion variable unit 609. The second motion variable unit 610 may be electrically connected to the first resistance terminal 405 (VT) to control a variable resistance. According to an exemplary embodiment, the second motion variable unit 610 may have a saw-toothed unit along an inner circumferential surface thereof, but embodiments are not limited thereto. The second motion variable unit 610 may be selectively combined with the first motion variable unit 609.

The crown unit 601, the crown axis 606, the first motion variable unit 609, and the second motion variable unit 610 may be accommodated in the housing unit 615.

Function of the variable resistance control unit 600 having the above-described construction will now be described.

When the variable resistance control unit 600 is operated, the disk unit 602 of the crown unit 601 may be pushed downward as shown in FIG. 6A. When the axis unit 603 of the crown unit 601 moves downward along the crown axis 606, the first motion variable unit 609 combined with the end portion of the axis unit 603 may also move down along the crown axis 606. A bottom surface 616 of the disk unit 602 may be disposed in a projection portion 614 of the housing unit 615. In this case, the elastic bias unit 512 interposed between the first motion variable unit 609 and the bottom portion 611 of the housing unit 615 may be compressed.

After moving downward, the first motion variable unit 609 may be combined with the second motion variable unit 610. That is, since both the outer circumferential surface of the first motion variable unit 609 and the inner circumferential surface of the second motion variable unit 610 have saw-toothed units, the first and second motion variable units 609 and 610 may engage with each other.

Next, when a driver is combined with the screw groove 605 formed in the disk unit 602 and the disk unit 602 rotates in one direction, the first motion variable unit 609 combined with the axis unit 603 may rotate so that the second motion variable unit 610 engaged with the first motion variable unit 609 may be capable of rotating. Accordingly, when the second motion variable unit 610 rotates in one direction, a common voltage may vary by controlling a variable resistance according to a rotation extent.

To release the operation of the variable resistance control unit 600, the disk unit 602 of the crown unit 601 may be pulled in an upward direction, as shown in FIG. 6B. When the axis unit 603 of the crown unit 601 moves upward along the crown axis 606, the first motion variable unit 609 combined with the end portion of the axis unit 603 may also move upward along the crown axis 606.

When the first motion variable unit 609 moves upward, the compressive force of the elastic bias unit 612 interposed between the first motion variable unit 609 and the bottom portion 611 of the housing unit 615 may be removed. The first motion variable unit 609 may move upward along the crown axis 606 due to the elasticity of the elastic bias unit 612. Thus, a combination of the first motion variable unit 609 with the second motion variable unit 610 may be released.

A variable resistor device for a display device and a method of controlling a variable resistance using the same may adopt a crown function and facilitate the control of the variable resistance. In addition, the variable resistor device may fix a variable resistor with the resolution of a screen of the display device optimized using the variable resistor, thereby minimizing, reducing, and/or preventing deformation of the variable resistor due to external force. Furthermore, after the variable resistor is fixed, a reoperation may be facilitated when a problem related to the variable resistance occurs. Moreover, after the variable resistor is fixed, coating a liquid coating material may be unnecessary.

By way of summation and review, an LCD panel may generate an electric field in a LC layer in response to a data signal, and adjust the transmittance of light passing through the LC layer by adjusting the intensity of the electric field. Thus, the LCD panel may display a desired image. When the polarity of a data voltage is inverted in response to the common voltage, flickering may occur in a screen of the LCD panel due to asymmetry between positive polarity and negative polarity.

To ameliorate flickering, a method of controlling a voltage of a common electrode by using a variable resistor has been proposed. However, even after the voltage of the common electrode is controlled, the variable resistance may be modified due to careless or inexperienced handling or the like. Accordingly, it may be necessary to minimize, reduce, and/or prevent fluctuation in the variable resistance.

Furthermore, after an operation is finished with the resolution of the screen optimized, a variable resistor may be fixed by coating a room-temperature curable liquid coating material around the variable resistor. Therefore, a process of coating the liquid coating material and management of the liquid coating material may be required.

Embodiments, e.g., the exemplary embodiments discussed above, relate to a variable resistor device, and more particularly, to a variable resistor device for a display device, and a method of controlling a variable resistance using the variable resistor device. The variable resistor device may minimize, reduce, and/or prevent the deformation of the variable resistor due to external force using a crown function. Further, the variable resistor device may minimize, reduce, and/or prevent fluctuation of a variable resistance after improving a flicker phenomenon by controlling a voltage of a common electrode using a variable resistor. Also, the variable resistor device may fix the variable resistor with the resolution of the display panel optimized using the variable resistor, thereby minimizing, reducing, and/or preventing deformation of the variable resistor due to external force. In addition, after the variable resistor is fixed, coating a liquid coating material may be unnecessary.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the present invention as set forth in the following claims

What is claimed is:

1. A variable resistor device of a display device, the display device including a display panel on which a pixel electrode and a common electrode are patterned, the variable resistor device comprising:

a variable resistor configured to vary a common voltage applied to the common electrode, the variable resistor including a plurality of resistance terminals on a circuit board and a variable resistance control unit configured to control resistances between resistance terminals of the plurality of resistance terminals that are electrically connected to one another, the variable resistance control unit including a crown unit, a crown axis combined with the crown unit and configured to guide up/down movement of the crown unit, a first motion variable unit combined with the crown axis, a second motion variable unit selectively combined with the first motion variable unit and configured to vary a variable resistance due to rotary power transmitted from the crown unit, and a housing unit configured to accommodate the crown unit, the crown axis, the first motion variable unit, and the second motion variable unit.

2. The device of claim 1, wherein the crown unit includes a disk unit having a screw groove and an axis unit extending downwardly from the disk unit, the crown axis being inserted into a hollow in the axis unit, and the axis unit being configured to be capable of ascending and descending along the crown axis and to be rotatable along with the crown axis when the axis unit reaches an upper limit of the crown axis.

3. The device of claim 2, further comprising a lever hinge-jointed with the axis unit wherein:

the first motion variable unit is combined with a circumference of the crown axis to be capable of ascending and descending along the crown axis, and when the axis unit ascends along the crown axis, the lever rotates downward and applies pressure to the first motion variable unit until the first motion variable unit reaches a bottom unit of the housing unit.

4. The device of claim 3, further comprising an elastic bias unit between the first motion variable unit and the bottom unit of the housing unit.

5. The device of claim 3, wherein the second motion variable unit is at the bottom unit of the housing unit along a circumference of the first motion variable unit, the second motion variable unit being interlocked and rotatably combined with the first motion variable unit when the first motion variable unit reaches the bottom unit of the housing unit.

6. The device of claim 5, wherein an outer circumferential surface of the first motion variable unit has a saw-toothed unit, and an inner circumferential surface of the second motion variable unit has a saw-toothed unit engagable with the saw-toothed unit of the first motion variable unit.

7. The device of claim 5, wherein at least a portion of the second motion variable unit is in contact with a semi-arc-shaped resistance layer electrically connected to at least one resistance terminal of the plurality of resistance terminals such that the second motion variable unit varies the variable resistance due to rotary motion.

8. The device of claim 1, wherein the crown unit includes a disk unit having a screw groove and an axis unit extending downwardly from the disk unit, the crown axis being inserted into a hollow in the axis unit, the axis unit being configured to be capable of ascending and descending along the crown axis, and the first motion variable unit being combined with a bottom unit of the axis unit to be capable of ascending and descending along with the axis unit.

9. The device of claim 8, wherein the first motion variable unit is disposed along a circumference of the crown axis, the first motion variable unit is combined with the axis unit to be capable of ascending and descending along the crown axis, and the first motion variable unit reaches a bottom unit of the housing unit when the axis unit reaches a lower limit of the crown axis.

10. The device of claim 8, further comprising an elastic bias unit between the first motion variable unit and a bottom unit of the housing unit.

11. The device of claim 10, wherein the second motion variable unit is at the bottom unit of the housing unit along a circumference of the first motion variable unit and interlocked and rotatably combined with the first motion variable unit after descent of the first motion variable unit.

12. The device of claim 11, wherein an outer circumferential surface of the first motion variable unit has a saw-toothed unit, and an inner circumferential surface of the second motion variable unit has a saw-toothed unit configured to engagable with the saw-toothed unit of the first motion variable unit.

13. The device of claim 11, wherein at least a portion of the second motion variable unit is in contact with a semi-arc-shaped resistance layer electrically connected to at least one resistance terminal of the plurality of resistance terminals such that the second motion variable unit varies the variable resistance due to rotary motion.

14. A method of controlling a variable resistance using a variable resistor device of a display device, the display device including a display panel in which a pixel electrode and a common electrode are patterned, the variable resistor device being configured to vary a common voltage applied to the common electrode and to control a variable resistance control unit of the variable resistor device to control resistances between a plurality of resistance terminals on a circuit board, the method comprising:

elevating a crown unit of the variable resistor that includes the crown unit having an axis unit, a crown axis combined with the crown unit and configured to guide movement of the crown unit, a first motion variable unit combined with the crown axis, a second motion variable unit selectively combined with the first motion variable unit, and a housing unit configured to accommodate the crown unit, the crown axis, the first motion variable unit, and the second motion variable unit;

descending the first motion variable unit to a bottom unit of the housing unit by allowing a lever hinge-jointed with the axis unit to rotate downward due to the elevating of the crown unit and to apply pressure to the first motion variable unit;

combining the first motion variable unit with the second motion variable unit at the bottom unit of the housing unit; and varying the variable resistance by allowing the second motion variable unit to receive rotary power from the crown unit and at least partially contact a resistance layer that is electrically to connected the plurality of resistance terminals on the circuit board.

15. The method of claim 14, wherein the elevating of the crown unit includes:

elevating the crown unit along the crown axis by pushing the crown unit upward with the crown axis inserted through a hollow in the axis unit, and rotating the crown unit along with the crown axis when the axis unit reaches an upper limit of the crown axis.

16. The method of claim 14, wherein the descending of the first motion variable unit to the bottom unit of the housing unit includes rotating the lever hinge-jointed with the axis unit downward during the elevating of the crown unit such that the first motion variable unit descends downward along the crown axis by a bottom end of the lever until the first motion variable unit reaches the bottom unit of the housing unit.

17. The method of claim 16, wherein the descending of the first motion variable unit includes elastically supporting the descending movement with an elastic bias unit between the first motion variable unit and the bottom unit of the housing unit.

18. The method of claim 14, wherein the combining of the first motion variable unit with the second motion variable unit includes engaging a saw-toothed unit of an outer circumferential surface of the first motion variable unit with a saw-toothed unit of an inner circumferential surface of the second motion variable at the bottom unit of the housing unit.

19. The method of claim 14, wherein the varying of the variable resistance using the second motion variable unit includes rotating the first motion variable unit to which rotary power is transmitted from the crown unit and rotating the second motion variable unit when interlocked with the first motion variable unit such that at least a portion of the second motion variable unit contacts the resistance layer.

20. A method of controlling a variable resistance using a variable resistor device of a display device, the variable resistor device including a display panel in which a pixel electrode and a common electrode are patterned, the variable resistor device being configured to vary a common voltage applied to the common electrode and to control a variable resistance control unit of the variable resistor device to control resistances between a plurality of resistance terminals on a circuit board, the method comprising:

descending a crown unit of the variable resistor that includes the crown unit having an axis unit, a crown axis combined with the axis unit and configured to guide movement of the axis unit, a first motion variable unit combined with an end portion of the axis unit, a second motion variable unit selectively combined with the first motion variable unit, and a housing unit configured to accommodate the crown unit, the crown axis, the first motion variable unit, and the second motion variable unit;

descending the first motion variable unit combined with the end portion of the axis unit to a bottom unit of the housing unit along the crown axis;

combining the first motion variable unit with the second motion variable unit at the bottom unit of the housing unit; and varying the variable resistance by allowing the second motion variable unit to receive rotary power from the crown unit and at least partially contact a resistance layer that is electrically connected to the plurality of resistance terminals on the circuit board.

21. The method of claim 20, wherein the descending of the crown unit includes descending the crown unit along the crown axis by pushing the crown unit downward with the crown axis inserted through a hollow in the axis unit.

22. The method of claim 20, wherein the descending of the first motion variable unit to the bottom unit of the housing unit includes descending the first motion variable unit combined with the end portion of the axis unit during a down movement of the axis unit along the crown axis until the first motion variable unit reaches the bottom unit of the housing unit.

23. The method of claim 22, wherein the descending of the first motion variable unit includes elastically supporting the descending movement with an elastic bias unit between the first motion variable unit and the bottom unit of the housing unit.

24. The method of claim 20, wherein the combining of the first motion variable unit with the second motion variable unit includes engaging a saw-toothed unit of an outer circumferential surface of the first motion variable unit with a saw-toothed unit of an inner circumferential surface of the second motion variable unit at the bottom unit of the housing unit.

25. The method of claim 20, wherein the varying of the variable resistance using the second motion variable unit includes rotating the first motion variable unit to which rotary power is transmitted from the crown unit and rotating the second motion variable unit when interlocked with the first motion variable unit such that at least a portion of the second motion variable unit contacts the resistance layer.

* * * * *